United States Patent [19]

MacDonald

[11] Patent Number: 4,666,074

[45] Date of Patent: May 19, 1987

[54] IMPACT NAILING AND DIMPLING APPARATUS

[76] Inventor: Donald K. MacDonald, 1180 Kilkare Rd., Sunol, Calif. 94586

[21] Appl. No.: 787,856

[22] Filed: Oct. 16, 1985

[51] Int. Cl.[4] ..... B25C 1/04

[52] U.S. Cl. ..... 227/66; 227/120; 227/130; 173/139

[58] Field of Search ..... 24/432.1, 432.2; 173/139; 206/345, 347; 227/8, 66, 93, 94, 95, 116, 117, 120, 130, 135, 136, 132

[56] References Cited

U.S. PATENT DOCUMENTS

| | | | |
|---|---|---|---|
| 1,161,033 | 11/1915 | Craig | 227/66 X |
| 2,442,949 | 6/1948 | Fischer | 227/66 X |
| 2,918,675 | 12/1959 | Smith | 227/66 |
| 3,027,560 | 4/1962 | Nelson | 227/66 |
| 3,040,327 | 6/1962 | Michel | 227/66 X |
| 3,640,655 | 2/1972 | Wallace | 425/109 |
| 3,711,008 | 1/1973 | Clifford et al. | 227/147 |
| 3,774,293 | 11/1973 | Golsch | 227/66 X |
| 4,341,336 | 7/1982 | Smith | 227/66 |
| 4,566,619 | 1/1986 | Kleinholz | 227/8 |
| 4,610,381 | 9/1986 | Kramer | 227/7 |

*Primary Examiner*—Paul A. Bell

*Attorney, Agent, or Firm*—Fliesler, Dubb, Meyer & Lovejoy

[57] ABSTRACT

An impact nailing and dimpling apparatus is described. In the apparatus there is provided a dimpler and valve assembly for automatically controlling the depth to which nails and dimples are set in a wallboard. A base member is also provided for orientating the apparatus for repeatedly and reliably driving nails into wallboard perpendicular to the wallboard.

23 Claims, 12 Drawing Figures

IMPACT NAILING AND DIMPLING APPARATUS

BACKGROUND OF THE INVENTION

1. Technical Field

The present invention relates to apparatus used for installing construction materials in general and to an automatic impact nailing and dimpling apparatus for driving a nail and setting a dimple to a predetermined depth in gypsum wallboard in particular.

2. Description of Prior Art

Gypsum board, also called wallboard and drywall, comprises processed gypsum which is sandwiched between sheets of paper. The board is usually provided in standard sheets 4 feet wide by 8 to 14 feet in length, ¼ to 1" thickness.

In many applications, such as in the construction of residential wood framed homes, the board is attached to wooden studs by nailing the board to the studs. The nails used typically comprise a cupped head. As each nail is driven through the wallboard and into the stud, it is countersunk in the wallboard. In the process of countersinking the nail in the wallboard, a dimple is formed in the wallboard. The dimples thus formed and butt joints between adjacent boards are then taped and covered with a wallboard compound for providing a smooth uniform surface. Thereafter the surface is painted or covered with a plaster for providing an attractive and aesthetically pleasing appearance.

In the past, the nailing of wallboard to a wooden stud has been done using a conventional wallboard hammer, a single-stroke automatic impact hammer or the like.

In using a wallboard hammer, a nail is hammered into the wallboard and the stud until the base of the head of the nail is flush with the surface of the wallboard. Thereafter, a single stroke of the hammer using the convex surface of the hammer countersinks the nail and at the same time forms a dimple in the wallboard.

A principal disadvantage of the above-described method for installing wallboard is that the head of the nail is struck by the convex surface of the hammer before the convex surface of the hammer contacts the surface of the wallboard. This tends to cause the head of the nail to pierce the paper covering of the wallboard. Also, if the nail is not driven perpendicular to the wallboard, the sharp edge of the head of the nail will tend to pierce the paper covering the wallboard. Once the surface paper covering is pierced, it loses its integrity which reduces the holding ability of the cup headed nail.

Another disadvantage of the above-described method for installing wallboard is that it is time consuming.

Still another disadvantage of the above-described method is that it is difficult to set nails and dimples repeatedly at uniform and preferred depths.

In a typical prior known single-stroke automatic impact nailer and dimpler there is provided a piston member and nail set assembly which is pneumatically driven in a single-stroke fashion, a nail feeding mechanism which automatically feeds nails to a position beneath the nail set, a dimpler having a convex exterior surface with a hole centrally located therein which is activated by the piston member for creating a dimple in the wallboard as the nail is being set, and a triggering mechanism to control the operation of the apparatus.

In operation, the nail is driven through the hole in the dimpler by the piston and when the piston strikes the dimpler, it causes the dimpler to dimple the wallboard.

A principal disadvantage of the above-described single-stroke automatic-type nailing and dimpling apparatus is that, in general, there is no means provided in the apparatus for automatically controlling the depth to which a nail and a dimple is set in the wallboard. As a consequence, if the air pressure in the apparatus varies or the hardness of the wood studs to which the wallboard is nailed varies, the depth to which each of the nails is driven cannot be accurately controlled. This may result in nails not being driven deep enough or driven too deeply. If the nails are not driven deep enough, they will not be properly countersunk and if the dimpler is not driven deep enough, the paper will not be properly dimpled. Alternatively, if the nails and dimpler are driven too deep this can cause the nails and/or the dimpler to tear the surface paper, causing the nails to lose their holding ability.

Another disadvantage of prior known automatic nailing and dimpling apparatus is that in such apparatus there is generally no means, such as a sole plate or housing, for insuring that a nail is hammered into the wallboard perpendicular to the wallboard. This often results in a sharp edge of the nail pressing into the paper covering of the wallboard resulting in a greater tendency for the nail to cut through the paper covering of the wallboard as described above.

SUMMARY OF THE INVENTION

In view of the foregoing, a principal object of the present invention is an automatic impact nailing and dimpling apparatus comprising means for automatically setting a nail or other fastener and a dimple to a predetermined depth in a gypsum wallboard or other substrate.

Another object of the present invention is an apparatus as described above comprising means for controlling the angle at which a nail is hammered into the wallboard such that the angle is substantially perpendicular to the wallboard.

In accordance with the above objects there is provided an impact nailing and dimpling apparatus. In the apparatus there is provided a dimpler and a hammer assembly comprising a movable piston and a nailset which are movably mounted in a housing of the apparatus and a nail feeding mechanism for feeding nails into the apparatus beneath the nailset. Located in a compressed air channel in the apparatus between a source of compressed air and the dimpler and the hammer assembly, there is provided a compressed air control valve. The valve is provided for controlling a flow of compressed air from the source to the dimpler and the hammer assembly including the piston. Extending from the dimpler to the valve is a valve control member for controlling the operation of the valve.

In operation, the apparatus is first connected to a source of compressed air which causes the dimpler and hammer assembly to be automatically retracted into the housing and a nail inserted beneath the nailset. The housing is then placed in contact with a wallboard. The activation of a trigger member then causes the compressed air control valve to be moved to a first position wherein the dimpler and hammer assembly are freed to move and compressed air is channeled to the piston causing the piston to reciprocate and drive the nail and dimpler into the wallboard. When the dimpler has been moved a predetermined distance relative to the housing, the valve control member extending from the dimpler causes the valve to be moved from its first position to a second position wherein the valve interrupts the flow of compressed air to the piston thereby stopping the reciprocal movement of the piston and further movement of the dimpler into the wallboard. By adjusting the length of the valve control member, the depth of the dimple is controlled. By adjusting the length of the nailset, the depth of the nail relative to the dimple is controlled.

A further feature of the present invention is that the housing orientates the nailset and dimpler perpendicular to the wallboard so that the nail is driven perpendicularly into the wallboard.

By means of the foregoing described features of the present invention, the nailing and dimpling of gypsum wallboard to wooden studs is rendered uniform and repeatable regardless of variations in the density of the wooden studs and in the thickness of the wallboard being attached to the stud. Furthermore, by means of the above-described feature, the uniform and repeatable nailing annd dimpling of the wallboard to wooden studs can be achieved even by relatively inexperienced persons.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Figure 1:
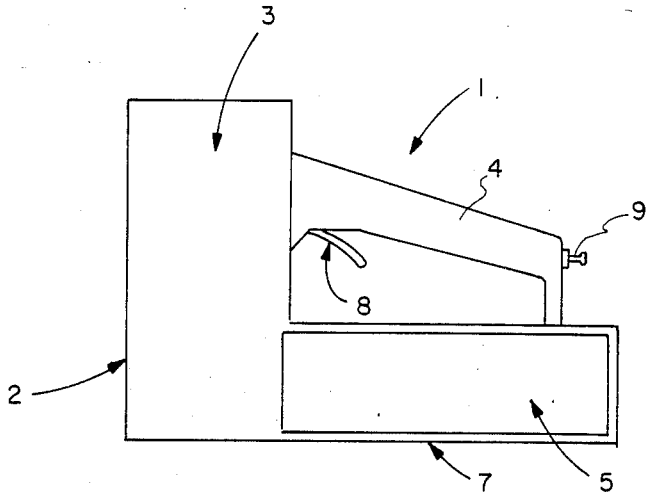
FIG. 1 is a side elevation view of a dimpling and nailing apparatus according to the present invention.
Figure 2:
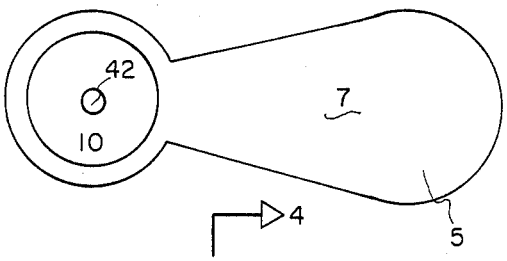
FIG. 2 is a bottom view of the apparatus of FIG. 1.
Figure 3:
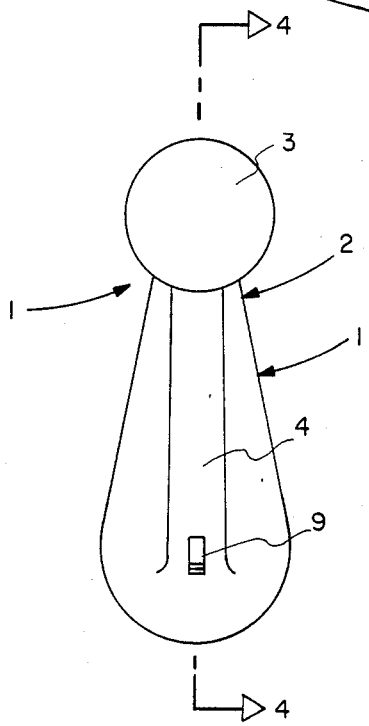
FIG. 3 is a top view of the apparatus of FIG. 1.

Referring to FIGS. 1–3, there is provided in accordance with the present invention an impact nailing and dimpling apparatus designated generally as 1. In the apparatus 1 there is provided a housing designated generally as 2 comprising a cylindrical hammer and dimple assembly housing 3, a handle 4, a nail receiving compartment 5 fitted with a removable cover 6 and a smooth planar surface on the bottom of the housing 3 and compartment 5, for forming a stabilizing/orientating sole plate or base member 7. Extending downwardly from the handle 4 there is provided the finger-actuated portion of a trigger assembly designated generally as 8. Extending from the rear of the handle 4 there is provided a fitting 9 for coupling the apparatus 1 to a source of compressed air (not shown).

Figure 4:
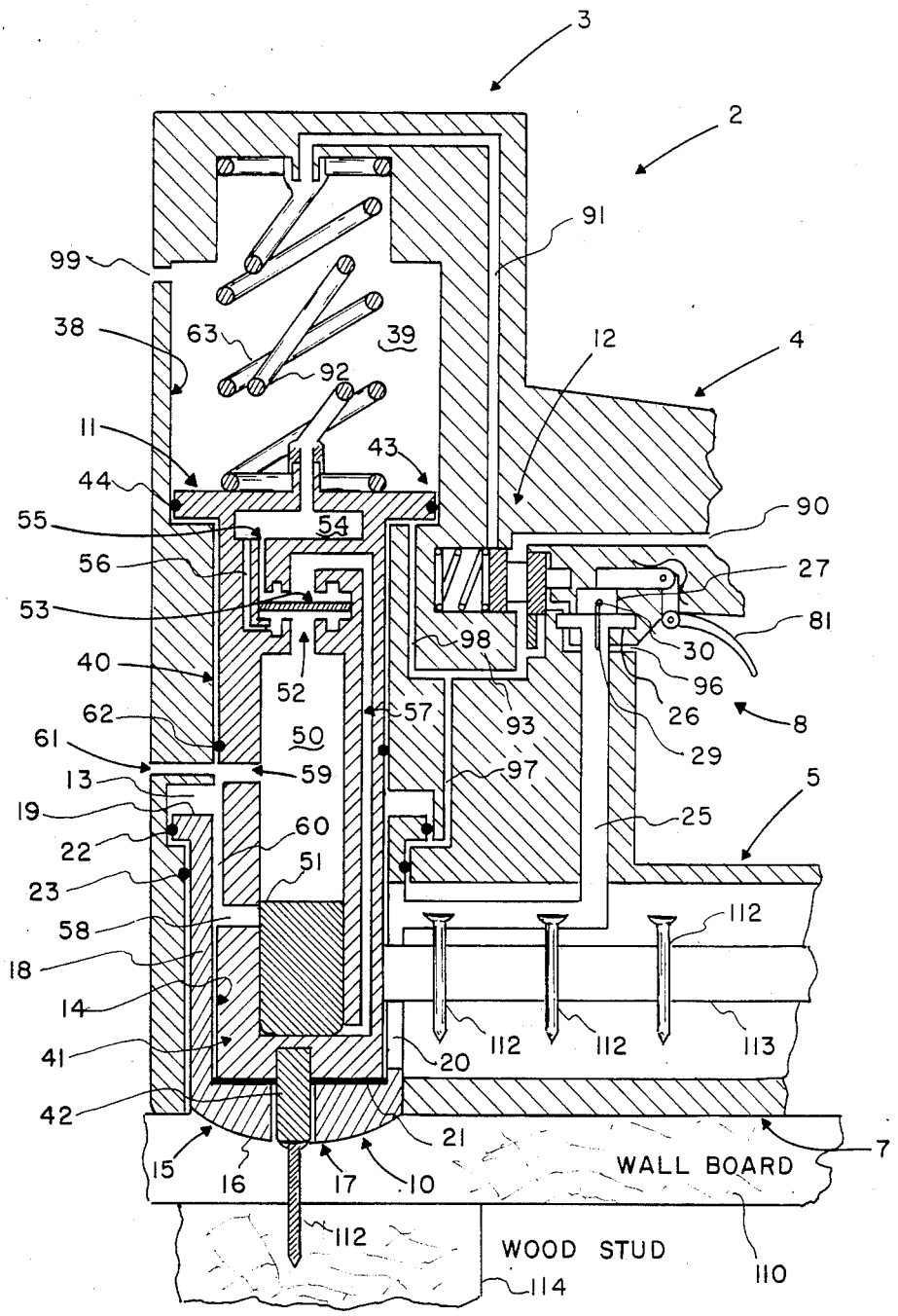
FIG. 4 is a partial cross-sectional view of the apparatus of FIGS. 1–3 taken in the direction of the lines of 4—4 of FIG. 3.

Referring to FIG. 4, there is movably mounted in a bore centrally located in the housing 3 a cylindrically-shaped dimpler 10 and a cylindrically-shaped hammer assembly 11. Extending beneath the handle 4 there is provided a compressed air control valve assembly 12 and the trigger assembly 8.

In the dimpler 10 there is provided an open-ended cavity or bore 14, an end wall 15 comprising an exterior convex surface 16 and a sidewall 18 forming the bore 14. Centrally located in the wall 15 there is provided a hole 17. Extending outwardly from the top end of the side wall 18 into a recess 13 provided therefor there is provided an annular flange 19. On the right side of the dimpler 10 there is provided in the side wall 18, in communication with the nail chamber 5, an elongated nail receiving slot 20. Fitted to the interior of the wall 15 there is provided a resilient pad member 21. Fitted in a recess provided therefor in the periphery of the annular flange 19 there is provided an O-ring 22 for providing a compressed air seal between the interior wall of the recess 13 and the flange 19. Mounted in a recess provided therefor in the wall of the housing 3 below the flange 19 and O-ring 22, there is provided another O-ring 23. Ring 23 is provided for providing another compressed air seal between the wall 18 of the dimpler 10 and an interior wall of the bore in the housing 3. Extending to the right from the dimpler 10 there is provided an L-shaped valve control member 25.

Figure 5:
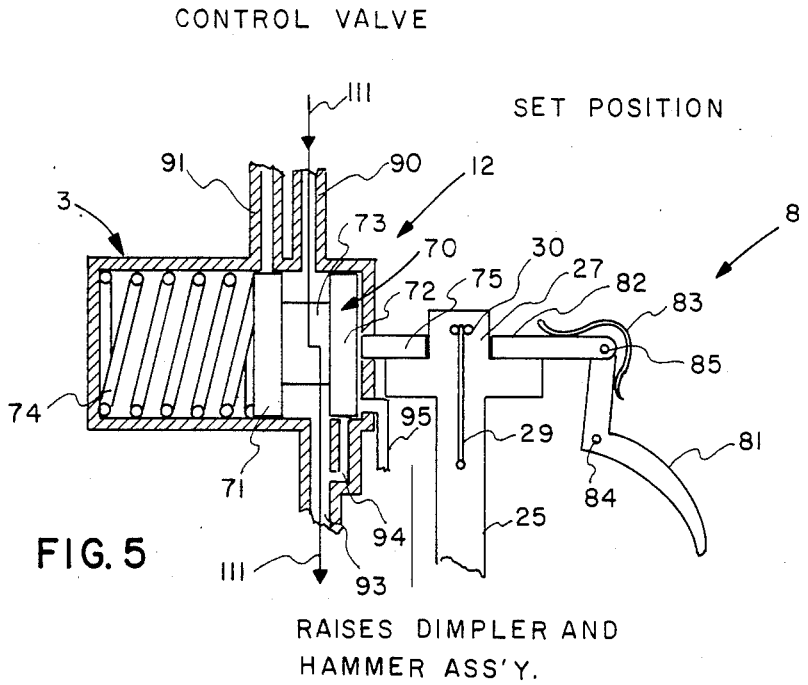
FIGS. 5 and 6 are partial cross-sectional views of a compressed air control valve and trigger assembly according to the present invention.
Figure 6:
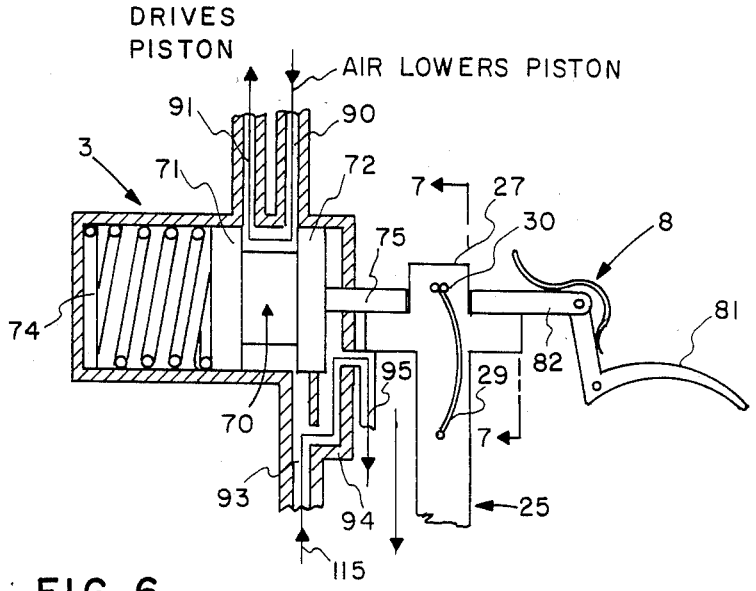
Figure 7:
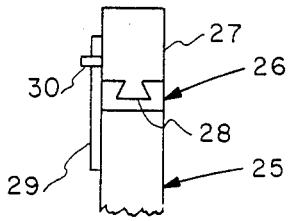
FIG. 7 is a partial end view of a valve control member according to the present invention taken along lines 7—7 of FIG. 6.
Figure 8:
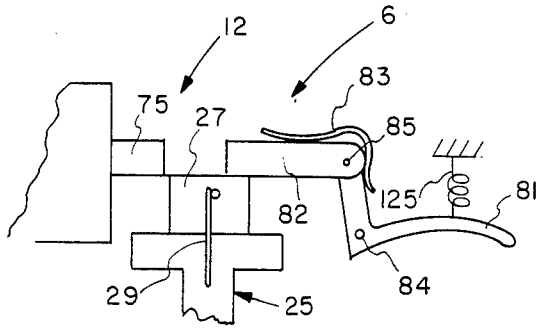
FIGS. 8–10 are partial elevation views of the valve and trigger assembly of FIGS. 5 and 6 showing various positions thereof.

Referring to FIGS. 5–7, at the top of the member 25 there is provided a T-shaped section 26. Slidably mounted to the upper surface of the section 26 there is provided a block member 27. The block member 27 is slidably connected to the section 26 by means of a dovetail mortise and tendon 28. A leaf spring 29 is attached to and extends from the member 25 for engaging a pin 30 which extends outwardly from the block 27.

In the hammer assembly 11 there is provided a cylindrically-shaped hollow housing 40. In the lower end of the housing 40 there is provided a wall 41. Centrally located in the wall 41 in registration with the hole 17 in the dimpler 10 there is provided a nailset 42. Nailset 42 is adjustably threaded into the end wall 41 and extends downwardly therefrom into the hole 17 when the hammer assembly 11 is in its lowest position as shown in FIG. 4. Extending outwardly from the top of the hammer assembly 11 and into a recess 38 provided therefor in the wall of a cavity 39 in the interior of the housing 3 above the bore 14, there is provided an annular flange 43. In the periphery of the flange 43 there is provided an O-ring 44. O-ring 44 is provided for providing a compressed air seal between the hammer assembly 11 and the wall of the recess 38 in the housing 3.

Movably mounted in a bore 50 provided therefor in the housing 40 of the assembly 11 there is provided a piston member 51. Movably mounted in a cavity 52 provided therefor in the upper end of the housing 40 there is provided a flutter valve member 53. Above the valve member 53 there is provided a compressed air manifold 54. Extending from the manifold 54 to the top of the member 53 there is provided a compressed air channel 55. Extending from the manifold 54 to the bottom surface of the member 53 there is provided a compressed air channel 56. Channel 55 is provided to have a larger diameter than channel 56 in order to provide a differential air pressure on the upper and lower surfaces of the member 53 as will be further described below. Extending from the upper surface of the member 53 to the lower end of the piston 51 in a wall of the housing 40, there is provided a compressed air channel 57. Extending through aother portion of the wall of the housing 40 there is provided a pair of compressed air channels 58 and 59. Extending between the channels 58 and 59 between the housing 40 and the dimpler 10, there is provided a compressed air channel 60. The channels 58 and 59 and 60 are provided to communicate with a compressed air channel 61 which is provided in a wall of the housing 3.

In a recess provided therefor in the wall of the housing 3 above the channel 61 there is proivded an O-ring 62. The O-ring 62 is provided for providing a compressed air seal between the assembly 11 and the interior wall of the bore 14 in the housing 3. Located above and in the cavity 39 for providing a relatively light constant spring force on the assembly 11 there is provided a spring member 63.

Referring again to FIGS. 5, 6, and 7, there is provided in the valve assembly 12 in a cavity provided therefor in the housing 3, a spool-shaped valve member 70 comprising a pair of disk-shaped end members 71 and 72 which are located on opposite ends of a smaller diameter cylindrically-shaped member 73. In contact with an exterior wall of the member 71 there is provided a return spring 74. Extending from an exterior wall of the member 72 there is provided a valve piston member 75 which is adapted to be contacted by the member 27.

In contact with the opposite side of the member 27, there is provided the trigger assembly 8. In the trigger assembly 8 there is provided a finger actuating member 81, a block actuating member 82 and a spring member 83. The member 81 is pivotally attached to the housing 3 by means of a pin 84. The member 82 is pivotally attached to the member 81 by means of a pin 85.

Extending from the fitting 7 described above with respect to FIG. 1 to the valve assembly 12, there is provided a compressed air input channel 90. Extending from the valve assembly 12 to the upper end of the housing 3 there is proivded a compressed air channel 91. As shown more clearly in FIG. 4, extending from the interior end of the channel 91 to the manifold 54 in the upper end of the hammer assembly 11, there is provided a flexible tubing 92. Extending from the lower side of the valve assembly 12 there is provided a compressed air channel 93. Extending from the upper end of the compressed air channel 93 to the valve assembly 12 there is provided a compressed air channel 94. Extending from the rear of the assembly 12 through the housing 3 there is provided a compressed air channel 95.

As seen more clearly in FIG. 4, the compressed air channel 95 extends through the housing 3 and is terminated by a compressed air exhaust port 96 which is shown located beneath the trigger assembly 8. Extending from the lower end of the compressed air channel 93 to the under surface of the flange 19 of the dimpler 10 there is provided a compressed air channel 97. Extending from the lower end of the compressed air channel 93 to the under surface of the flange 43 of the hammer assembly 11 there is provided a compressed air channel 98. Extending through a wall of the housing 3 above the hammer assembly 11 there is provided a compressed air exhaust port 99.

In operation, a plurality of nails 112 which are removably attached to a relatively stiff, thin plastic or paper ribbon 113, or the like, are inserted in the nail compartment 5 as shown in FIG. 4. Thereafter, a source of compressed air (not shown) is coupled to the apparatus 2 by attaching the source of compressed air to the fitting 9. When the source of compressed air is attached to the fitting 9, the compressed air flows through the channel 90 to the valve assembly 12. With the valve member 70 in the position shown in FIGS. 4 and 5, the compressed air in the channel 90 passes through the valve member 70 and into the compressed air channel 93 as shown by the arrow 111. From the compressed air channel 93, the compressed air is directed through the compressed air channels 97 and 98. At this time, it will be noted that the member 71 of the valve member 70 blocks the compressed air channel 91 and the compressed air channel 94.

As will be seen more clearly in FIG. 4, the compressed air in channel 97 which is directed to the underside of the flange member 19 of the dimpler 10, will raise the dimpler 10 until the upper surface of the flange 19 contacts the facing surface of the recess 13, thus retracting the dimpler 10 into the housing 3. At the same time, the compressed air in the compressed air channel 98 directed to the underside of the flange 43 of the hammer assembly 11 will raise the hammer assembly 11 until the upper surface of the flange 43 contacts the facing surface of the recess 38 in the housing 3. As the assembly 11 is raised, air is exhausted through the port 99. The distances the dimpler 10 and assembly 11 are raised creates a nail receiving space between the lower end of the nailset 42 in the hammer assembly 11 and the interior surface of the wall 15 of the dimpler 10 above the hole 17. Thereafter, one of the nails 112 on the ribbon 113 is automatically positioned beneath the nailset 42 by any suitable automatic feeding mechanism (not shown).

With the dimpler 10 and hammer assembly 11 in their raised or retracted position and a nail located beneath the nailset 42, the base 7 of the apparatus 2 is placed firmly against a wallboard 111 with the nail located over a stud 114 as shown in FIG. 4. By placing the base 7 firmly against the wallboard 110, the nail 112 will be oriented perpendicular to the wallboard 110. Thereafter, the trigger member 81 in the valve assembly 12 is depressed.

Referring to FIG. 6, as the trigger member 81 is depressed, the member 82 pushes against the block 27 and the force of the spring 29. As the block 27 is moved, it pushes against the member 75 extending from the valve member 70, moving the valve member 70 to the left. As the valve member 70 is moved to the left, the valve member 71 opens the compressed air channel 91 to compressed air from the compressed air channel 90. At the same time, the valve member 72 blocks the compressed air channel 93 from compressed air from the compressed air channel 90 and opens the compressed air channels 94 and 95 to compressed air from the channels 93, 97 and 98.

With the valve member 70 in the position shown in FIG. 6, the spring member 63 forces the hammer assembly 11 downwardly, causing the nailset 42 to contact the nail 112 located therebeneath, strip the nail 112 from the ribbon 113 and drive it, at least partially, into the wallboard 110. As the hammer assembly 11 is driven downwardly by the spring 63, compressed air located beneath the flange 43 is exhausted through the compressed air channels 98, 93, 94 and 95, as shown by the arrow 115 in FIG. 6. At the same time, compressed air from the channel 90 is directed through the channel 91, the flexible tubing 92 to the air manifold 54 in the upper end of the hammer assembly 11.

Figure 11:
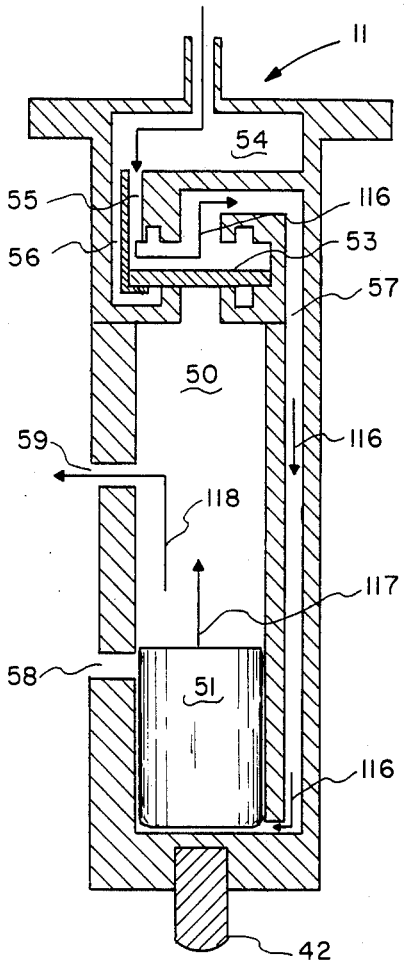
FIGS. 11 and 12 are partial cross-sectional views showing the operation of a flutter valve and piston assembly according to the present invention.

Referring to FIG. 11, because the compressed air channel 55 has a larger diameter than the compressed air channel 56, the flutter valve member 53 will be driven to its lower position as shown in FIG. 11. With the flutter valve member 53 in its lower position, the compressed air in the manifold 54 is directed through the compressed air channels 55 and 57 to the lower end of the piston member 51, as shown by the arrows 116, causing the piston member 51 to be driven upwardly, as shown by the arrow 117. As the piston member 51 is driven upwardly as shown by the arrow 117, the air in the cavity 50 is exhausted through the compressed air channel 59 in the hammer assembly 11, as shown by the arrow 118, and the compressed air channel 61 in the housing 3. As the piston member 51 is driven past the compressed air channel 59, it closes the channel 59 compressing the air between its upper surface and the flutter valve member 53 causing the flutter valve member 53 to be driven to its upper position, as shown in FIG. 12.

Figure 12:
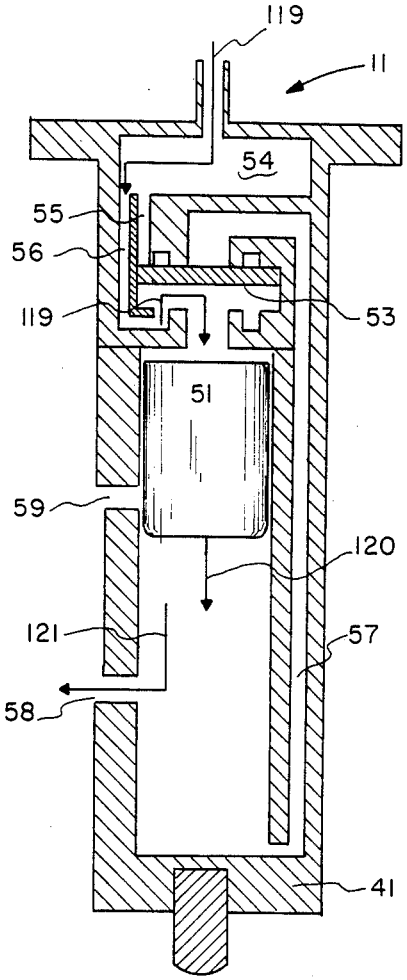

With the flutter valve member 53 in its upper position as shown in FIG. 12, compressed air from the manifold 54 is directed through the compressed air channel 56, as shown by the arrows 119, driving the piston downwardly as shown by the arrow 120. As the piston member 51 is driven downwardly, the air compressed beneath the piston 51 is exhausted through the compressed air channel 58 in the hammer assembly 11, as shown by the arrow 121, the compressed air channel 60 between the hammer assembly 11 and the housing 3 and the compressed air channel 61 in the wall of the housing 3. As the air is exhausted from beneath the piston member 51, the momentum of the piston member 51 carries it against the end wall 41 of the hammer assembly 11. As the piston member 51 strikes the end wall 41 of the hammer assembly 11, it hammers the nail 112 engaged by the nailset 42 into the wallboard 110 and the wooden stud 114 located therebeneath. After the piston 51 is driven to its lowest position in the hammer assembly 11, the compressed air above the piston member 51 is exhausted through the compressed air channels 59, 60 and 61 allowing the flutter valve member 53 to return to its lower position, as shown in FIG. 11.

As the nail 112 is driven into the wallboard 110 and 112 by reciprocal motion of the piston member in the assembly 11, the end wall 41 of the hammer assembly 11 contacts the interior of the wall 15 of the dimpler 10, driving the dimpler 10 into the wallboard 110 and creating a concave dimple therein. At the same time, the assembly 11 and nailset 42 sets the nail 112 in the bottom of the dimple. As the dimpler 10 is driven downwardly into the wallboard 110 it lowers the member 25 and block 27 relative to the valve assembly 12. When the dimpler 10 has been driven a predetermined distance into the wallboard 110 and relative to the housing 3, the block member 27 on the upper surface of the L-shaped member 25 is withdrawn from between the member 75 of the valve assembly 12 and the member 82 of the trigger assembly 8 allowing the spring member 74 to return the valve member 70 in the valve assembly 12 to its initial position as shown in FIG. 5.

Preferably, with the hammer assembly 11 and dimpler 10 in their lowest position, the length of the nailset 42 is adjusted such that the base of the head of the nail will be flush with the surface 16 of the dimpler 10. This will prevent the nail from being driven into or through the paper in the bottom of the dimple.

Figure 9:
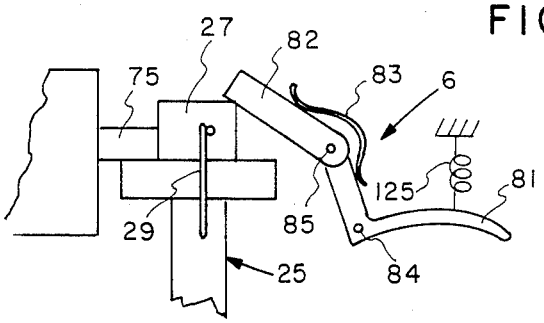
Figure 10:
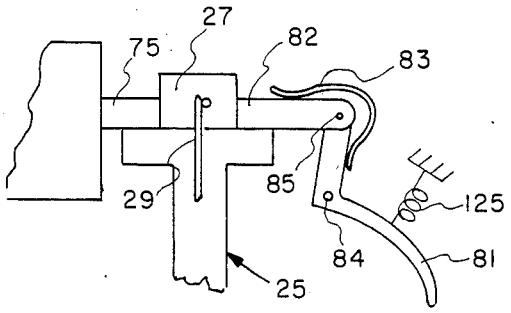

With the valve member 70 of the valve assembly 12 in its initial position, both the dimpler 10 and the hammer assembly 11 are raised or retracted into the housing 3 and a nail 112 is inserted below the nailset 42 as described above. As the dimpler 10 is retracted, the block 27 is raised, the member 27 contacts the underside of the member 82 of the trigger assembly 8 causing the member 82 to pivot about its pivot pin 85 against the spring force of the spring 83, as shown in FIG. 9. Thereafter, a release of the member 81 allows the member 81 to be pivoted by a spring 125 about its pivot pin 84 retracting the member 82 and allowing the spring 83 to return the member 82 to its initial position as shown in FIG. 10 readying the apparatus 2 for another cycle of operation.

While a preferred embodiment of the present invention is described above, it is contemplated that various modifications may be made thereto without departing from the spirit and scope of the present invention. Accordingly, it is intended that the embodiment described above be considered only as illustrating the invention and that the scope of the invention be determined by reference to the claims hereinafter provided.

What is claimed is:

1. An impact nailing and dimpling apparatus comprising:

means movably mounted in said apparatus for providing a dimple in a surface of an exterior member against which said dimple providing means is hammered;

means movably mounted in said apparatus for repetitively hammering said dimple providing means into said surface of said exterior member;

means for detecting when said dimple providing means has been hammered a predetermined distance into said surface; and means responsive to said detecting means for stopping said hammering means.

2. An apparatus according to claim 1 wherein said dimple providing means comprises a member having a convex surface for providing a concave dimple in said surface of said exterior member.

3. An apparatus according to claim 1 comprising:

a housing having an internal bore which is open at one end;

means for movably mounting said dimple providing means in said bore; and means for moving said dimple providing means in said bore from an extended position whereat an end of said dimple providing means extends beyond said end of said bore in a retracted position whereat said end of said dimple providing means is retracted into said bore.

4. An apparatus according to claim 3 wherein said means for moving said dimple providing means in said bore from said extended position to said retracted position comprises means for directing compressed air against said dimple providing means.

5. An apparatus according to claim 4 wherein said dimple providing means comprises an outwardly extending flange member which extends into a recess provided therefor in a wall of said bore and said compressed air directing means comprises means for directing compressed air against said flange member.

6. An apparatus according to claim 3 wherein said end of said dimple providing means comprises a wall having an exterior convex surface and a hole centrally located in said wall.

7. An apparatus according to claim 1 comprising:

a housing having a bore located therein;

means for movably mounting said dimple providing means and said hammering means in said bore and wherein said hammering means comprises:

a hammer assembly;

first means for moving said hammer assembly away from said dimple providing means; and second means for moving said hammer assembly toward said dimple providing means.

8. An apparatus according to claim 7 wherein said first means for moving said hammer assembly comprises means for directing compressed air against said hammer assembly.

9. An apparatus according to claim 8 wherein said hammer assembly comprises an outwardly extending flange member which extends into a recess proivded therefor in a wall of said bore and said compressed air directing means comprises means for directing compressed air against said flange member.

10. An apparatus according to claim 7 wherein said second means for moving said hammer assembly comprises a spring member.

11. An apparatus according to claim 7 wherein said second means for moving said hammer assembly comprises means for applying a periodic force to said hammer assembly.

12. An apparatus according to claim 11 wherein said periodic force applying means comprises:

a piston member movably mounted in a piston bore provided therefor in said hammer assembly; and means for moving said piston member in a periodic fashion away from and against a wall of said piston bore.

13. An apparatus according to claim 12 wherein said piston member moving means comprises means for selectively directing compressed air against a first surface of said piston member facing said wall of said piston bore to move said piston member from a first position to a second position away from said wall of said piston bore and against a second surface of said piston member facing away from said wall of said piston bore to move said piston member from said second position to said first position against said wall of said piston bore.

14. An apparatus according to claim 13 wherein said means for selectively directing compressed air against said first and said second surfaces of said piston member comprises:

a first air passageway for directing compressed air to said first surface of said piston member;

a second air passageway for directing compressed air to said second surface of said piston member; and a flutter valve member which is movable between a first and a second position in response to compressed air from a source of compressed air and to air which is compressed in said piston bore by movement of said piston member from its first position to its second position for directing compressed air from said source to said first air passageway when said piston member and said flutter valve member are in their first position and to said second air passageway when said piston member and said flutter valve member are in their second position.

15. An apparatus according to claim 1 wherein said apparatus comprises a housing adapted to be placed in contact with said surface of said exterior member and said means for stopping said hammering means comprises means for stopping said hammering means when said dimple providing means has been moved a predetermined distance relative to said housing.

16. An apparatus according to claim 15 wherein said hammering means comprises:

a movable piston member;

first valve means responsive to a flow of compressed air from a source of compressed air and from air compressed by movement of said piston member for moving said piston member in a reciprocating fashion; and second valve means movable between a first and a second position for directing said compressed air from said source to said first valve means when said second valve means is in its first position and for interrupting said flow of compressed air from said source to said first valve means when said second valve means is in its second position, and wherein said stopping means comprises means for moving said second valve means from its first position to its second position when said dimple providing means has been moved said predetermined distance relative to said housing.

17. An apparatus according to claim 16 comprising a trigger member and wherein said dimple providing means has a retracted position and said second valve moving means comprises means coupled to said dimple providing means for coupling said trigger member and said second valve means when said dimple providing means is in said retracted position and for decoupling said trigger member from said second valve means when said dimple providing means has been moved from said retracted position said predetermined distance relative to said housing.

18. An apparatus according to claim 17 wherein said coupling means comprises:

a first member attached to said dimple providing means for movement with said dimple providing means; and a second member movably attached to said first member for movement relative to said first member, said first member being adapted to position said second member between said trigger member and said second valve means for moving said second valve means from its second position to its first position when said dimple providing means is in its retracted position and said trigger member is depressed.

19. An apparatus according to claim 1 wherein said dimple providing means comprises:

a wall having a hole centrally located therein;

said hammering means comprises:

a nailset extending therefrom in registration with said hole is said dimple providing means;

means for moving said hammering means and nailset away from said dimple providing means to allow the insertion of a nail having a nail head in a space created thereby between said nailset and said hole in said dimple providing means; and means for moving said hammering means and nailset toward said dimple providing means so that said nailset makes contact with said head of said nail and drives said nail through said hole and thereafter said hammering means contacts said dimple providing means for driving said nail and said dimple providing means into said surface of said exterior member, said hammering means including a piston means and means for moving said piston means in a reciprocating fashion so as to apply a periodic force to said dimple providing means; and said stopping means comprises:

means for stopping said reciprocating movement of said piston means when said dimple providing means has been hammered said predetermined distance into said surface of said exterior member.

20. An apparatus according to claim 19 wherein said means for moving said hammering means toward said dimple providing means comprises a spring means, said means for moving said piston means in a reciprocating fashion comprises means for selectively directing compressed air against opposite surfaces of said piston means and said means for stopping said reciprocating movement of said piston means comprises means for interrupting a flow of compressed air to said compressed air directing means.

21. An apparatus according to claim 15 wherein said housing comprises means for orientating said apparatus relative to said surface of said exterior member when said orientating means is placed in contact with said exterior member such that a fastening member is driven into said exterior member perpendicular to said exterior member.

22. An apparatus according to claim 21 wherein said orientating means comprises a planar surface on the underside of said housing.

23. An apparatus according to claim 19 wherein said nailset comprises means for adjusting the maximum distance said nailset extends into said hole in said dimple providing means such that the undersurface of the head of a nail in contact with said nailset will be flush with the exterior surface of said dimple providing means when said nailset is fully inserted in said hole.

* * * * *